US006829992B2

(12) United States Patent
Kobayashi et al.

(10) Patent No.: US 6,829,992 B2
(45) Date of Patent: Dec. 14, 2004

(54) PAPER WEB WIDTH ADJUSTMENT DEVICE

(75) Inventors: Yoshio Kobayashi, Tokyo (JP); Tsunehiro Takeda, Tokyo (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 7 days.

(21) Appl. No.: 10/390,612

(22) Filed: Mar. 19, 2003

(65) Prior Publication Data

US 2004/0003732 A1 Jan. 8, 2004

(30) Foreign Application Priority Data

Jul. 3, 2002 (JP) ..... 2002-194040

(51) Int. Cl.[7] ..... B41F 13/54
(52) U.S. Cl. ..... 101/228; 101/425; 226/181
(58) Field of Search ..... 101/177, 180, 101/181, 183, 212, 219, 228, 425; 226/3, 181

(56) References Cited

U.S. PATENT DOCUMENTS 4,303,189 A * 12/1981 Wiley et al. ..... 226/15
5,152,522 A * 10/1992 Yamashita ..... 271/264
5,511,473 A * 4/1996 Ohmi et al. ..... 101/228
5,611,275 A * 3/1997 Iijima et al. ..... 101/181
5,647,584 A * 7/1997 Beaudreau et al. ..... 271/122
5,727,724 A * 3/1998 Dowling ..... 226/181
6,382,100 B1 * 5/2002 Satoh et al. ..... 101/212

FOREIGN PATENT DOCUMENTS

JP Hei-5-178511 7/1993

* cited by examiner

*Primary Examiner*—Eugene H. Eickholt
(74) *Attorney, Agent, or Firm*—Foley & Lardner, LLP

(57) ABSTRACT

The present invention relates to a device for adjusting the width of a paper web at a rotary lithographic press and the object of the present invention is to prevent ink or specks of paper from becoming attached to contact parts of a pressing member so as to contaminate the surface of the paper web, and to enable straightforward fitting and removing of a rotatable pressing member.

This configuration is therefore provided with one or more pressing members 1 with a plurality of contact members 11 provided integrally in a rotating manner so as to be capable of being mutually separated along the widthwise direction of a paper web W, a support shaft 20 supporting the pressing member(s) 1 in a rotatable manner, wavy surface adjustment means 2 capable of moving the support shaft 20 towards and away from the surface of the paper web W, and pressing member rotation drive means 4 for simultaneously rotating and driving the pressing member 1. It is then possible to move at least one of the pressing members 1 towards and away from the surface of the paper web W and rotational drive is possible in such a manner that rotational speed of the peripheral surfaces of the contact member 11 of the pressing member(s) 1 may be different to the speed of travel of the paper web W.

4 Claims, 5 Drawing Sheets

PAPER WEB WIDTH ADJUSTMENT DEVICE

BACKGROUND OF THE INVENTION

1. Field of the Invention

The present invention relates to a device for adjusting the width of a paper web after being printed on by at least one printing unit in a rotary lithographic press for printing on the paper web in an overlaid manner using a plurality of printing units. In particular, the present invention relates to a paper web width adjustment device for adjusting the width of a paper web by enabling an appropriate number of pressing members provided appropriately in a rotatable manner to be moved towards and away from the surface of the paper web so as to press against the surface of the paper web, deciding upon an appropriate position and then causing a ripple in the paper web.

2. Description of Related Art

In lithographic printing using dampening water, when the paper web passes through a printing unit, an image is printed and dampening water is provided via the non-image area parts. During this time, the pulp fiber of the paper web absorbs the dampening water and swells in the radial direction of the fiber so that the width of the paper web is enlarged.

Because of this, as shown, for example, in FIG. 6, with overlaid printing using a rotary lithographic press TP, there is a problem that mismatching occurs due to enlarging of the width of the paper web W between an image printed previously and an image printed later.

In order to resolve this problem the applicant proposed Japanese Patent Laid-open Publication No. Hei. 5-178511 (related art 1). In related art 1, as a "web paper width adjustment device, web paper width adjustment method, and a rotary lithographic press having the web paper width adjustment device", technology is disclosed for adjusting the width of a paper web by providing rotatable pressing members between the printing units facing both surfaces of the paper web and moving the pressing members towards and away from the surfaces of the paper web, having the pressing members come into contact with the surfaces of the paper web and having the pressing members press the paper web while rotating in the direction of travel of the paper web so as to generate a ripple in the paper web.

The paper web width adjustment device of related art 1 comprises a plurality of pressing members provided in the widthwise direction of the paper web so as to be rotatable while making contact with the traveling paper web and being provided alternately on both sides of the paper web so as to sandwich the paper web, shafts provided side by side so as to pass through the pressing members on each side of the paper web and be rotatable and supported about the same central line, eccentric sleeves provided so as to be fixed at both ends of each shaft so as to be capable of being angularly displaced about a common central line differing from the central lines, gears provided so as to engage with gears of the shafts provided side by side in an angularly displaceable manner so as to be integral with the eccentric sleeves and be fitted to each of the eccentric sleeves, and a drive source for driving each of the gears.

The paper web width adjustment device of related art 1 transmits drive using the drive source, causes the eccentric sleeves to be displaced angularly due to angular displacement of the gears, and the plurality of pressing members supported in a rotatable manner on the shafts fitted at a position eccentric with respect to the central lines of the eccentric sleeves are made to move about the central lines of the eccentric sleeves so as to move towards and away from the surface of the paper web.

In an embodiment of a paper web width adjustment device of related art 1, pressing surfaces 1 pressing web paper W traveling towards the print unit P are made to face both surfaces of the web paper W. The pressing surface 1 facing one surface of the web paper W and the pressing surface 1 facing the other surface of the web paper W are placed alternately along the widthwise direction of the web paper W. Pressing surfaces 1*a*, 1*b*, 1*c* . . . 1*f* pressing one of the surfaces of the web paper W are the surfaces of rollers 2*a*, 2*b*, 2*c* . . . 2*f* fitted in an mutually spaced manner so as to be rotatable at the shaft 3*a*. Pressing surfaces 1*g*, 1*h*, 1*i* . . . 1*k* facing the other surface of the web paper are the surfaces of rolls 2*g*, 2*h*, 2*i* . . . 2*k* fitted in an mutually spaced manner so as to be positioned at the centers of rollers 2*a*, 2*b*, 2*c*, . . . 2*f* so as to be rotatable at the shaft 3*b*.

The paper web width adjustment device (web paper width adjustment device 20) of the related art is a device where the shafts 3*a* and 3*b* are supported using eccentric sleeves 4*a*, 4*b*, 4*c* and 4*d*. The eccentric sleeves 4*a*, 4*b*, 4*c* and 4*d* are then made to rotate so as to displace the shafts 3*a* and 3*b* and the rollers 2*a*, 2*b*, 2*c* . . . 2*k* collectively fitted to the rollers 2*a*, 2*b*, 2*c* . . . 2*k* fitted to the shafts 3*a* and 3*b* are displaced.

The pressing members (pressing surfaces 1) of related art 1 are made to move collectively towards and away from both surfaces of the paper web by the ripple adjustment means and are pressed against both sides of the paper web while being made to rotate as a result of making contact with the surfaces of the paper web. A ripple effect is therefore generated in a widthwise direction of the paper web, the width of the paper web is adjusted, and there results an action preventing mismatching of printed images.

In related art 1, the pressing members are moved towards and away from the surface of the paper web by the ripple adjustment means so as to make contact and push against the paper web. The pressing member therefore rotates at substantially the same rotational speed as the speed of travel of the paper web in the direction of travel of the paper web in accompaniment with the contact points of the pressing member. Ink printed at a printing unit upstream of the direction of travel of the paper web or specs of paper that have become attached to the paper surface are therefore moved towards the contact parts of the pressing member and deposited due to the rotational displacement of the contact points of the pressing members at substantially the same speed as the paper web. There is therefore a problem that ink and specs of paper deposited at the contact points in this manner subsequently moves to the paper surface of the traveling paper web so as to contaminate the surface of the printing paper.

Further, the contact points of the pressing member are constructed in such a manner that an outer ring to which an inner ring is fixed is rotatable, with a plurality of contact points being provided in the direction of the shafts. The operation of fitting and removing the pressing members to the shafts is therefore not straightforward. In particular, pressing members positioned at the central part of a shaft ride up towards the fitting positions of pressing members further towards the ends of the shafts. Moving as far as a fitting position of a prescribed central portion is therefore necessary which results in a complicated operation.

Further, drive transmitted from the drive source is transmitted to gears that angularly displace integrally with the eccentric sleeves provided at both sides of the pressing members so that the pressing members are moved towards and away from the surfaces of the paper web. It is therefore necessary for the number of gears provided for the drive system to be equal to the number of eccentric sleeves provided on both sides of the pressing member, and initial costs therefore become high.

SUMMARY OF THE INVENTION

As the present invention sets out to resolve the aforementioned problems encountered in the related art, it is the object of the present invention to provide a paper web width adjustment device capable of preventing ink or specks of paper from becoming attached to contact parts of pressing members so thus contaminating the surface of the paper web, and to enable straightforward fitting and removing of rotatable pressing members. It is a further object to simplify the transmission mechanism for the ripple adjustment means for moving the pressing members towards and away from the surfaces of the paper web.

In order to resolve the aforementioned problems, it is proposed to provide a paper web width adjustment device comprises: one or more pressing members provided in a rotatable manner for making contact with surfaces of traveling paper web and creating ripples in the paper web and having a plurality of contact points provided integrally so as to be spaced at intervals along the widthwise direction of the paper web;

support shafts for supporting the pressing members in a rotatable manner;

ripple adjustment means capable of moving the support shafts towards and away from the surfaces of the paper web; and pressing member rotational drive means for, in cooperation with the pressing members, rotatably driving the pressing members, wherein at least one of the pressing members is capable of moving towards and away from a surface of the paper web, and the rotational speed of the peripheral surfaces of the contact points of the pressing members can be rotatably driven at different speeds to the speed of travel of the paper web.

With the paper web width adjustment device disclosed here, two pressing members are provided facing each other on either side of the paper web.

With the paper web width adjustment device as proposed here, the ripple adjustment means comprises eccentric sleeves fitted in a fixed manner to the ends of the support shafts, and a drive transmission mechanism capable of angularly displacing the eccentric sleeves, being provided in such a manner that central lines of rotation of the pressing members provided in a rotatable manner and the support shafts and central lines of angular displacement of the eccentric sleeves are spaced from each other and are parallel to each other, with the eccentric sleeves being angularly displaced about the center line of angular displacement by the drive transmission means, and with the ripple adjustment means being capable of deciding the positioning of the pressing members with respect to the paper web.

With the paper web width adjustment device as disclosed here, it is proposed that the drive transmission mechanism is equipped with worm wheels provided integrally with the eccentric sleeves in a rotatable manner, worms meshing with the worm wheels, and a rotational drive source for rotationally driving the worms.

DETAILED DESCRIPTION OF THE PREFERRED EMBODIMENTS

Figure 1:
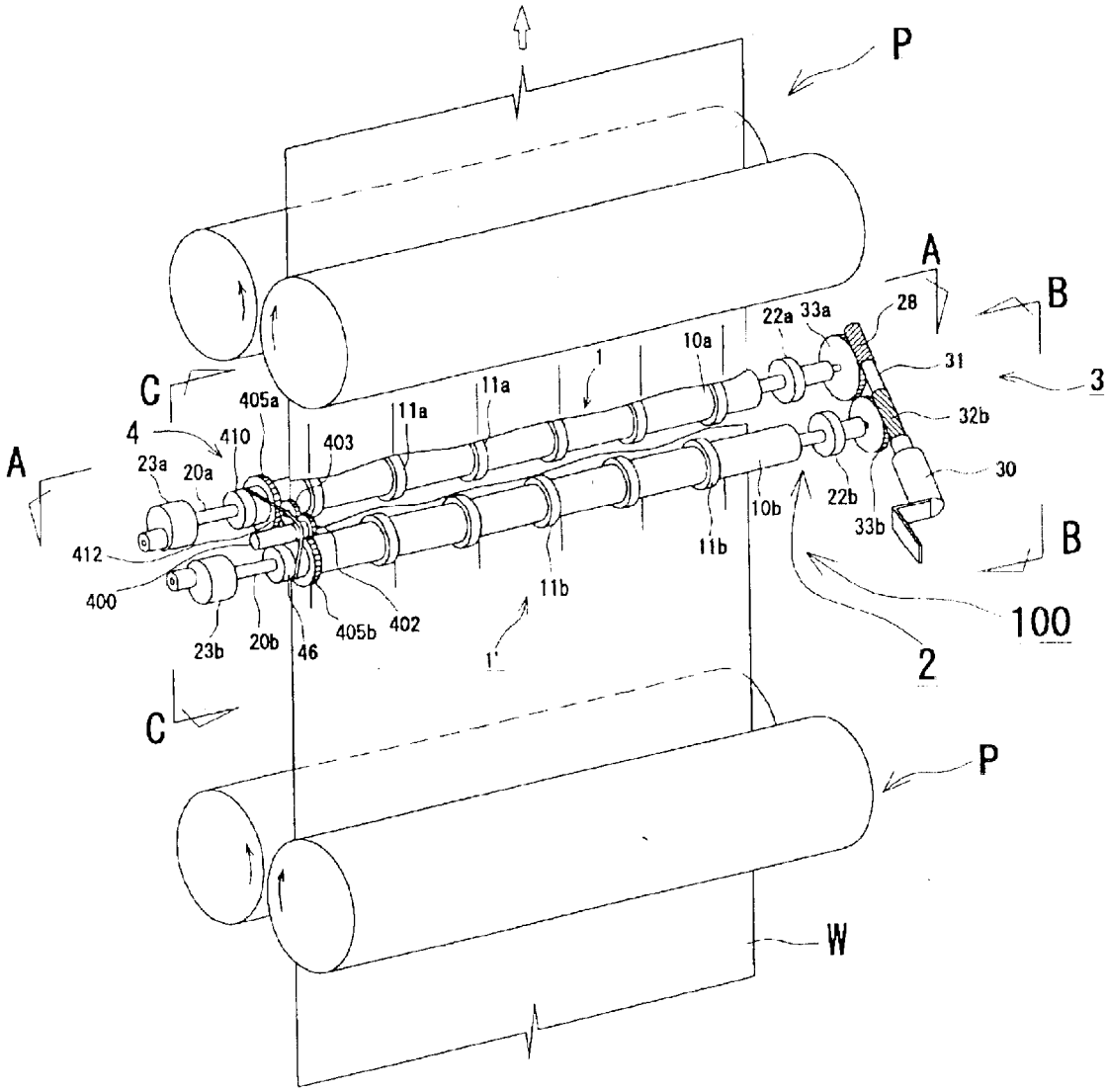
FIG. 1 is a perspective view showing an embodiment of this invention and shows an outline of a configuration for a paper web width adjustment device.
Figure 2:
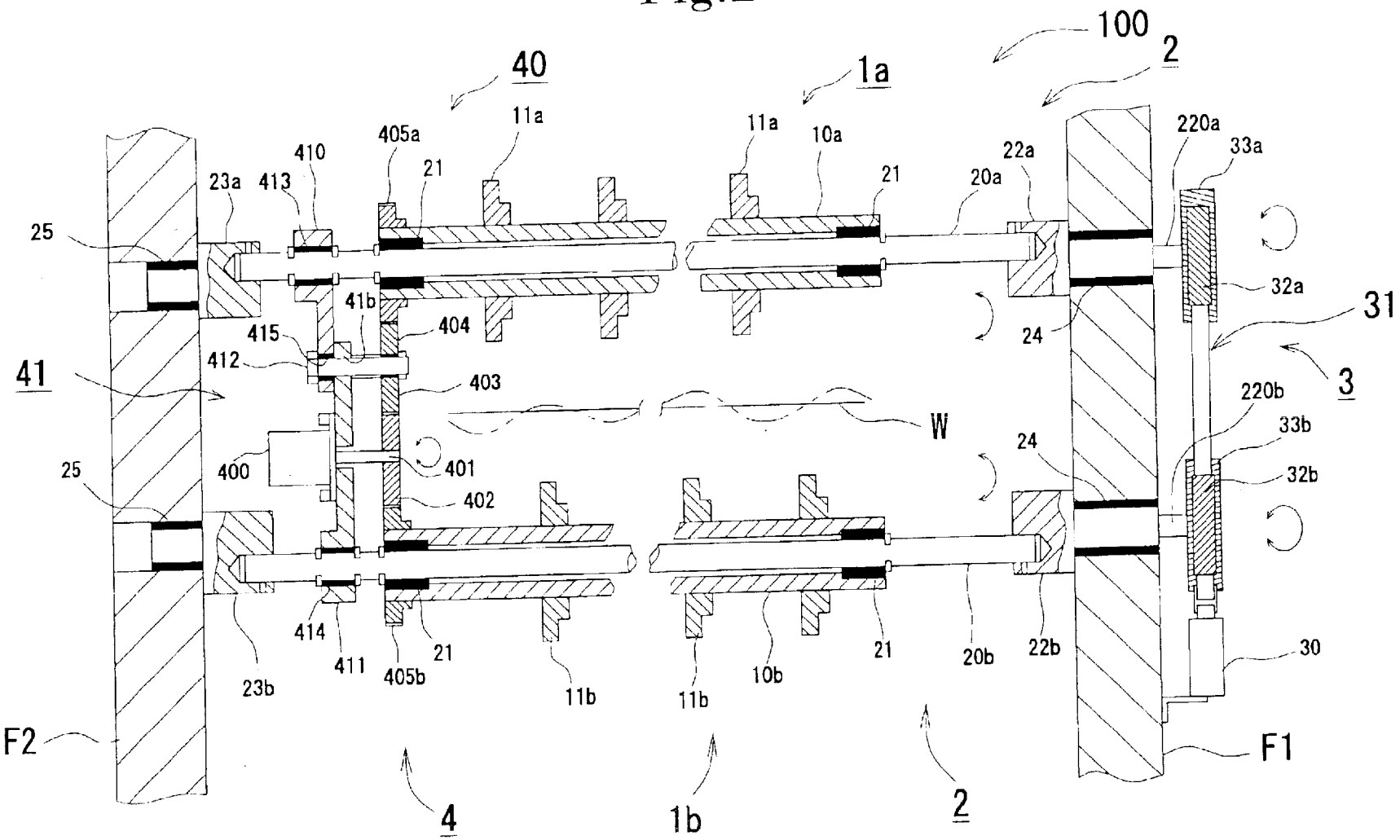
FIG. 2 is an outline cross-sectional as viewed in a plane taken along line A—A of FIG. 1.
Figure 3:
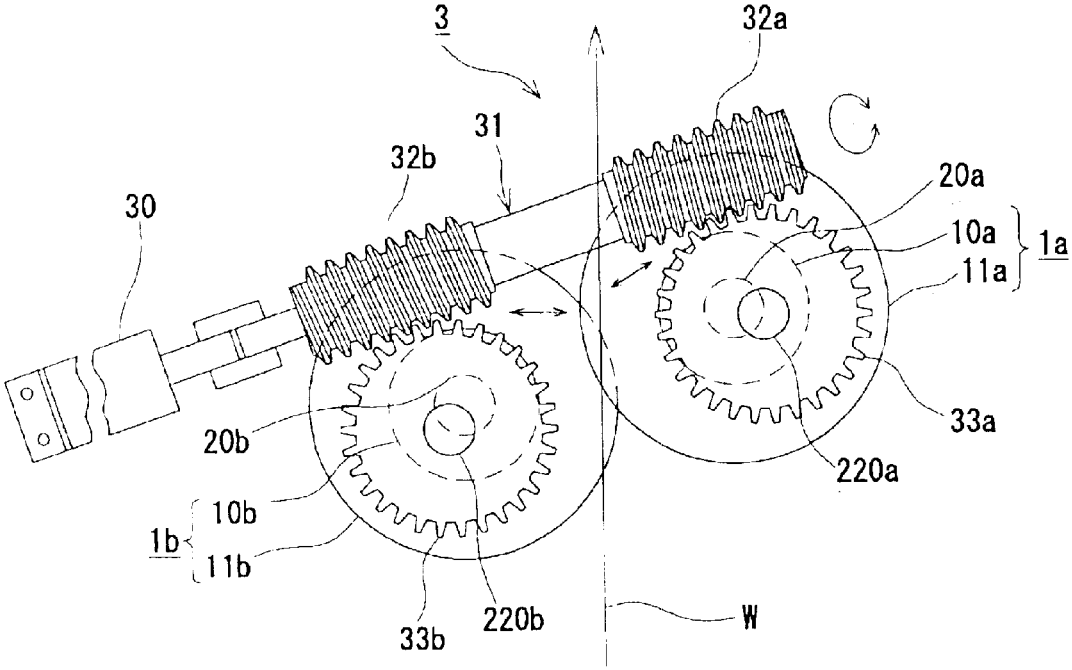
FIG. 3 is a front view showing an outline of ripple adjustment means as viewed along line B—B of FIG. 1.
Figure 4:
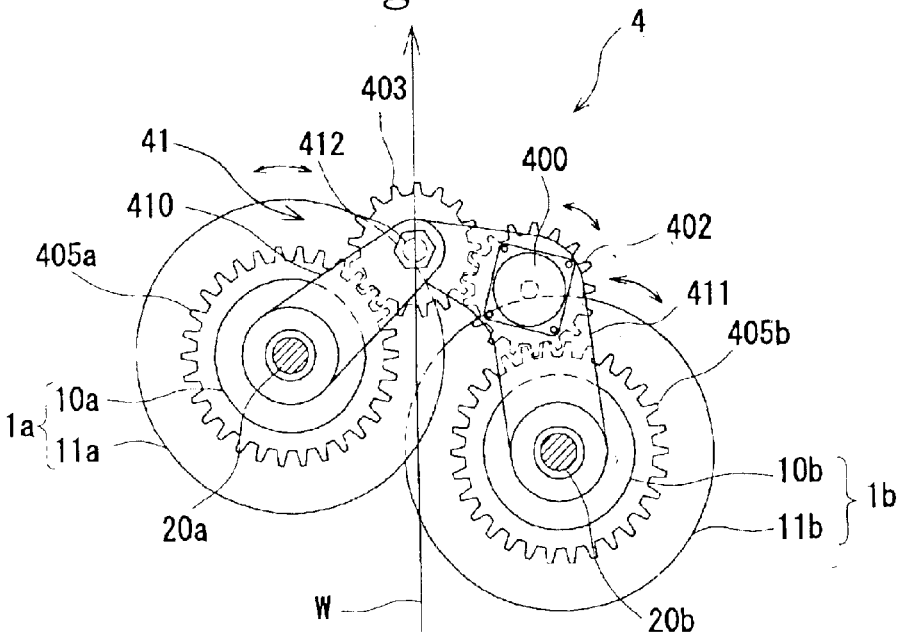
FIG. 4 is an outline front view of rotational drive means for the pressing member and is a plan view taken along line C—C in FIG. 1.
Figure 5:
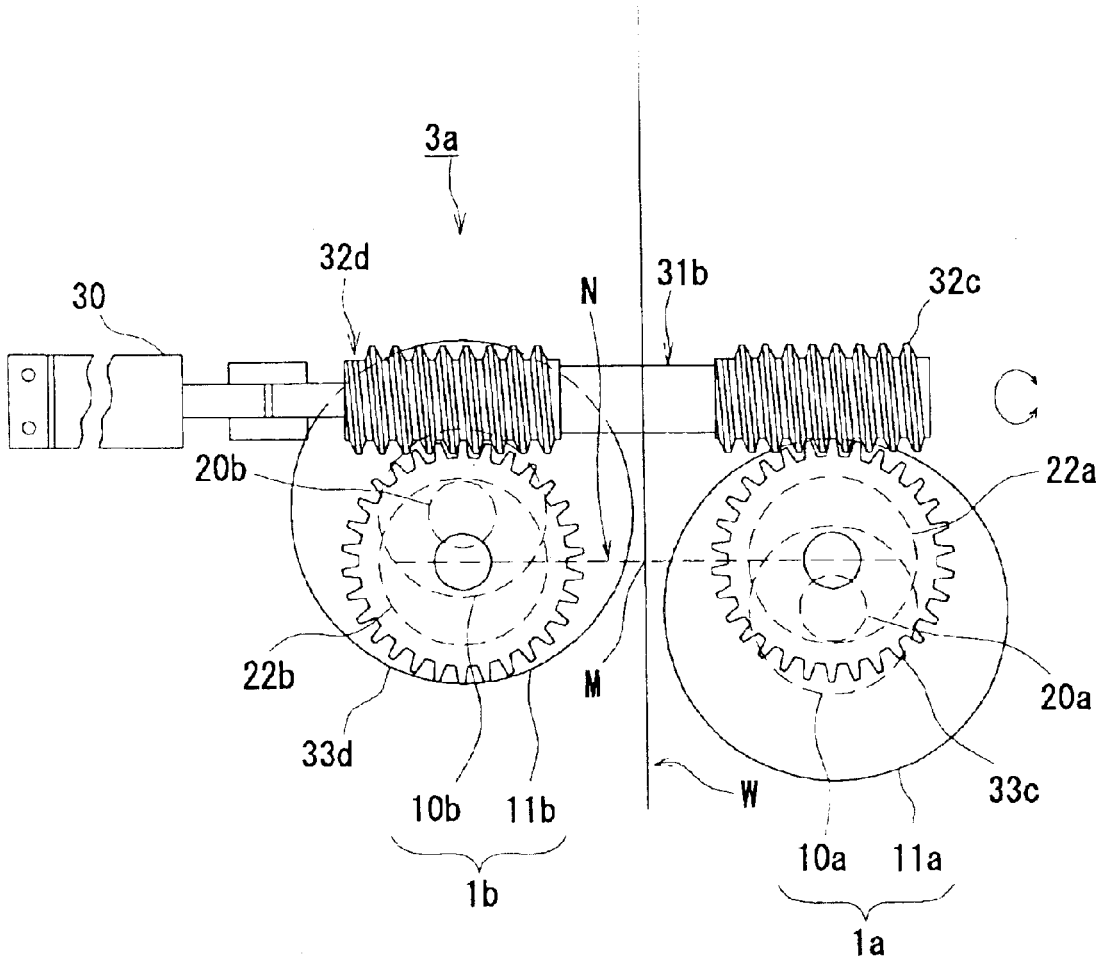
FIG. 5 is an outline front view of a second embodiment of a drive transmission mechanism of this invention.
Figure 6:
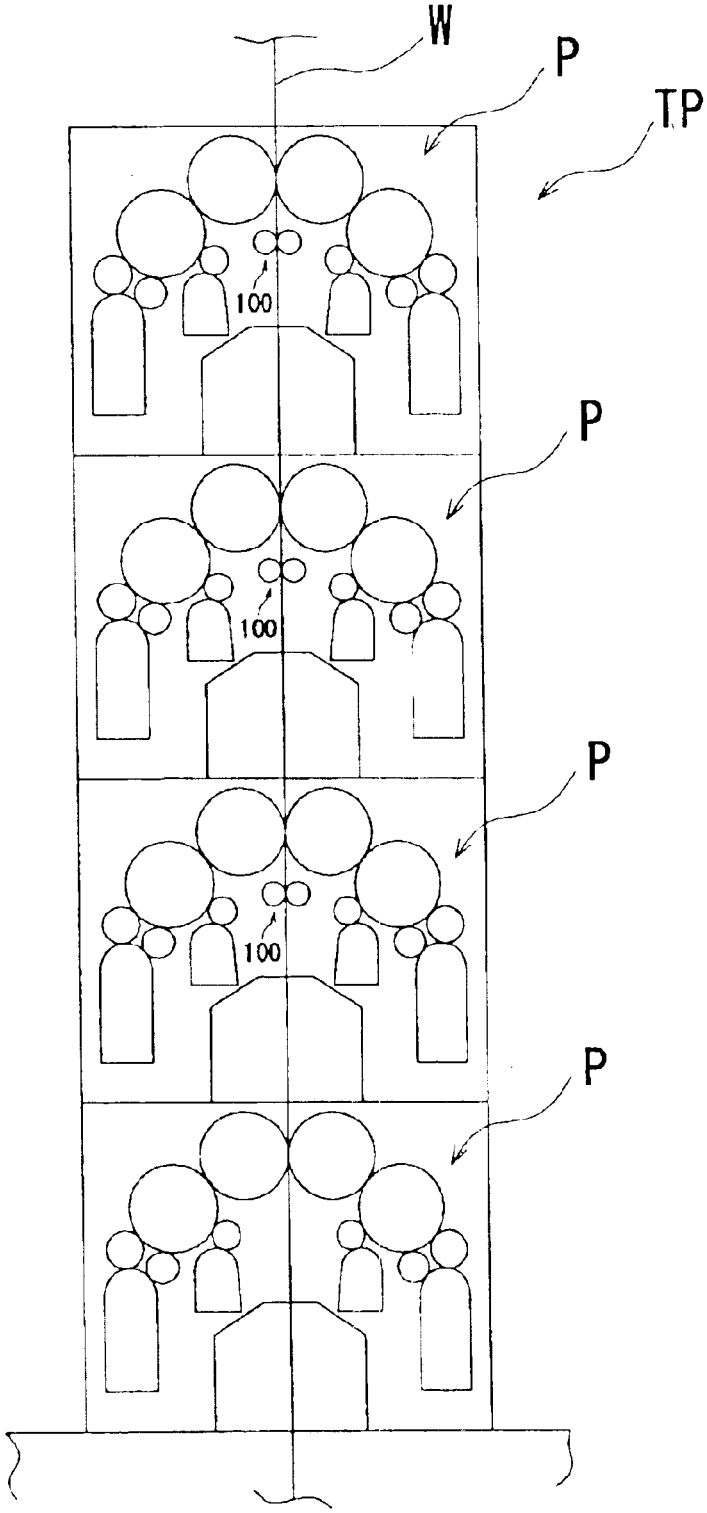
FIG. 6 is an outline plane view of a rotary lithographic press capable of having printing units perform overlaid printing.

A description is now given of an embodiment of this invention based on FIG. 1 constituting a perspective view showing an outline of a configuration for a paper web width adjustment device, FIG. 2 constituting an outline cross-sectional view as viewed in a plane taken along line A—A of FIG. 1, FIG. 3 constituting a front view showing an outline of ripple adjustment means as viewed along line B—B of FIG. 1, FIG. 4 constituting an outline front view of rotational drive means for the pressing member and is a cross-sectional view taken along line C—C in FIG. 1, FIG. 5 constituting an outline front view of a second embodiment of a drive transmission mechanism of this invention, and FIG. 6 is an outline plan view of a rotary lithographic press capable of having printing units perform overlaid printing.

A paper web width adjustment device 100 of the embodiment of the invention is provided between each printing unit P, so as to follow printing carried out by a single printing unit P, of a rotary lithographic press TP for printing in an overlaid manner using a plurality of printing units P on a paper web W traveling in the vertical direction as shown in FIG. 6.

Pressing members 1*a* and 1*b*, wavy surface adjustment means 2 having a drive transmission mechanism 3, and pressing member rotational drive means 4 are provided at the paper web width adjustment device 100 shown in FIG. 1.

The pressing members 1*a* and 1*b* are provided relative to each other on either side of the paper web W traveling in the vertical direction from bottom to top. The pressing member 1*a* on the side of one surface is provided so at to be parallel with respect to the surface of the paper web W and is provided in a direction at right-angles with respect to the direction of travel of the paper web W. The pressing member 1*a* comprises a cylindrical rotating shaft 10*a* provided so as to be rotatable centered about the axial center of a support shaft 20*a* of the wavy surface adjustment means 2, and a plurality of contact points 11*a* provided at appropriate intervals within the range of the width of the paper web W along the axial direction of the rotating shaft 10*a*. The respective contact points 11*a* are fitted to the outer surface of the rotating shaft 10*a* and are both integral with and capable of rotating together with the rotating shaft 10*a*, and make contact with one surface of the paper web W.

A pressing member 1*b* on the side of the other surface of the paper web W is provided so as to be parallel with respect to the surface of the paper web W and is provided in a direction at right-angles with respect to the direction of travel of the paper web W. The pressing member 1*b* comprises a cylindrical rotating shaft 10*b* provided so as to be rotatable centered about the axial center of a support shaft 20*b* of the wavy surface adjustment means 2, and a plurality of contact points 11*b* provided at appropriate intervals within the range of the width of the paper web W along the axial direction of the rotating shaft 10*b*. The respective contact points 11*b* are provided so as to be offset in a widthwise direction of the paper web W with respect to the contact points 11*a* of the pressing member 1*a* of one surface, are fitted to the outer surface of the rotating shaft 10*b* so as to be integral with and be capable of rotating together with the rotating shaft 10*b*, and make contact with the other surface of the paper web W.

Regarding the pressing member 1*a* and pressing member 1*b* for the first embodiment shown in FIG. 1 to FIG. 4, the pressing member 1*a* is positioned so as to be offset further downstream than the pressing member 1*b* with respect to the direction of travel of the paper web W. However, as a further embodiment, the pressing member 1*a* and the pressing member 1*b* may be located at the same position (same height) with respect to the direction of travel of the paper web W.

The wavy surface adjustment means 2 is a device for moving the pressing members 1*a* and 1*b* positioned relative to each other on either side of the paper web W towards and away from the surfaces of the paper web W and for deciding upon a position for stopping positions for the pressing members 1*a* and 1*b* that are being moved towards and away from the surfaces of the paper web.

The wavy surface adjustment means 2 is comprised of the support shaft 20*a*, the support shaft 20*b*, a bearing 21, eccentric sleeves 22*a* and 22*b*, eccentric sleeves 23*a* and 23*b*, a bearing 24, bearing 25, and the drive transmission mechanism 3.

The support shaft 20*a* passes through the cylindrical rotating shaft 10*a* of the pressing member 1*a* at the side of one of the surfaces of the paper web W and supports the rotating shaft 10*a* in a rotatable manner via the bearing 21. The support shaft 20*b* passes through the cylindrical rotating shaft 10*b* of the pressing member 1*b* at the side of the other surface of the paper web W and supports the rotating shaft 10*b* in a rotatable manner via the bearing 21.

The support shaft 20*a* and the support shaft 20*b* are hung across a frame F1 and frame F2 so as to face each other. One end of each shaft is then fixed to the eccentric sleeves 22*a* and 22*b*, and the other ends of the shafts are fixed to the eccentric sleeves 23*a* and 23*b*. Fitting is such that the axial centers of the support shaft 20*a* and the support shaft 20*b* are fitted in such a manner that the ends of the shafts are fixed at positions where the axial center of support shaft 20*a* and support shaft 20*b* are, eccentric from a common central line of angular displacement for the eccentric sleeves 22*a* and 23*a* and the eccentric sleeves 22*b* and 23*b*.

The central lines for the eccentric sleeve 22*a*, the eccentric sleeve 23*a*, and the support shaft 20*a* spanning the eccentric sleeves 22*a* and 23*a*, and the central lines for the eccentric sleeve 22*b*, the eccentric sleeve 23*b* and the support shaft 20*b* spanning the eccentric sleeves 22*b* and 23*b* are set so as to be substantially symmetrical taking the paper web W as a boundary. A distance between a central line for the facing support shafts 20*a* and 20*b* and both surfaces of the paper web W is substantially the same distance. Further, distances between central lines for the eccentric sleeve 22*a* and the eccentric sleeve 22*b* and both sides of the paper web W are substantially the same as distances between central lines for the eccentric sleeve 23*a* and eccentric sleeve 23*b* and both sides of the paper web W.

The eccentric sleeves 22*a* and 22*b* are provided via bearings 24, 24 at the side of frame F1 of the frames F1 and F2 provided facing each other so as to sandwich the support shaft 20*a* and the support shaft 20*b*. Eccentric sleeves 23*a* and 23*b* are also provided in a rotatable manner via bearings 25, 25 at the side of the frame F2.

The eccentric sleeves 22*a* and 22*b* are provided integrally with shaft ends 220*a* and 220*b* extending to the outside on the side of the frame F1 and central lines of rotation of the eccentric sleeve 22*a* and the shaft end 220*a* are the same, with central lines of rotation for the eccentric sleeve 22*b* and the shaft end 220*b* also being the same. A worm wheel 33*a* of the drive transmission mechanism 3 is fitted to the shaft end 220*a* and a worm wheel 33*b* of the drive transmission mechanism 3 is fitted to the shaft end 220*b*.

The drive transmission mechanism 3 of this first embodiment is comprised of a rotational drive source 30, a rotational drive shaft 31, worms 32*a* and 32*b*, and worm wheels 33*a* and 33*b*.

The rotational drive source 30 is fixed to the outside of the frame F1 and comprises an electric motor in the first embodiment. Two worms 32*a* and 32*b* are provided so as to be fixed in an integral manner at the rotational drive shaft 31 of the rotational drive source 30. The inclination of the threads of the two worms 32*a* and 32*b* are threaded in opposite directions but rotate in the same direction at the same time. The worm 32*a* meshes with worm wheel 33*a* provided at the shaft end 220*a* and worm 32*b* meshes with the worm wheel 33*b* provided at shaft end 220*b*. Therefore, when the rotational drive shaft 31 of the rotational drive source 30 is rotated, the worm wheel 33*a* and the worm wheel 33*b* are angularly displaced in directions opposite to each other.

As a result of angular displacement of the worm wheels 33*a* and 33*b*, the shaft ends 220*a* and 220*b*, and the eccentric sleeves 22*a* and 22*b* are angularly displaced in mutually opposite directions and the support shafts 20*a* and 20*b* fitted to the eccentric sleeves 22*a* and 22*b* are similarly angularly displaced about the central line of rotation of the eccentric sleeves 22*a* and 22*b*. The positions of the support shafts 20*a* and 20*b* are then decided as the position where angular displacement stops.

The eccentric sleeve 22*a* is coupled to the eccentric sleeve 23*a* via the support shaft 20*a* and the eccentric sleeves 22*a* and 23*a* are provided at holes provided in the opposing frames F1 and F2 having central lines coinciding with common central lines of angular displacement in such a manner as to be collectively rotatable about the central line of the holes. The eccentric sleeve 22*b* is coupled to the eccentric sleeve 23*b* via the support shaft 20*b* and, as with the eccentric sleeves 22*a* and 23*a*, the eccentric sleeves 22*b* and 23*b* are provided at holes provided in the opposing frames F1 and F2 having central lines coinciding with common central lines of angular displacement in such a manner as to be collectively rotatable about the central line of the holes.

As a result of the eccentric sleeves 22*a* and 22*b* being angularly displaced by the rotational drive shaft 30 via worm wheels 33*aa* and 33*b*, the rotating shaft 10*a* of the pressing member 1*a* rotatably fitted to the support shaft 20*a*, the contact points 11*a* and the rotating shaft 10*b* of the pressing member 1*b* rotatably fitted to the support shaft 20*b*, and similarly the contact points 11*b* are angularly displaced about the respective central lines of rotation of the eccentric sleeves 22*a* and 22*b*. The opposing pressing members 1*a* and 1*b* are therefore moved towards and away from both surfaces of the paper web W in a substantially symmetrical and equidistant manner.

FIG. 5 shows a second embodiment of a drive transmission mechanism 3*a*. At the drive transmission mechanism 3 constituting the second embodiment, the support shaft 20*a* and the support shaft 20*b* are positioned in a mutually symmetrical manner about a central line of the support shaft 20*a* and the support shaft 20*b* with respect to a surface N including a central line for the angular displacement of the eccentric sleeve 22*a* and the eccentric sleeve 22*b* moving towards and away from the surfaces of the paper web W at substantially equal distances with respect to a line M intersecting the paper web W. In this case, the worm 32*c* and the worm 32*d* integrally provided at the rotational drive shaft 31*b* are made to go in the same direction as the inclination of the threads while at the same time the worm wheel 33*c* and worm wheel 33*d* meshing with the worm 32*c* and worm 32*d* are angularly displaced in the same directions. As a result of the angular displacement of the worm wheel 33*c* and the worm wheel 33*d* in the same direction, the support shaft 20*a* fitted to the eccentric sleeve 22*a* and the support shaft 20*b* fitted to the eccentric sleeve 22*b* are moved towards and away from each surface of the paper web W at substantially the same distance while being offset slightly back and forth in the direction of travel.

In a further embodiment A (not shown) of a drive transmission mechanism 3 for moving the support shaft 20*a* and support shaft 20*b* towards and away from the surfaces of the paper web W in a substantially symmetrical manner and at substantially the same distance, the worm 32*a* engaging with the worm wheel 33*a* and the worm 32*b* engaging with the worm wheel 33*b* are provided separately, the worm 32*a* and worm 32*b* are provided with separate rotational drive sources, and the worm wheel 33*a* and worm wheel 33*b* are angularly displaced separately. The worm wheel 33*a* and the worm wheel 33*b* are independently angularly displaced, and the facing support shaft 20*a*, pressing member 1*a*, support shaft 20*b*, and pressing member 1*b* are made to move towards and away from both surfaces of the paper web W in a substantially symmetrical manner and at substantially the same distances.

In a further embodiment B (not shown) of a drive transmission mechanism 3 for moving the support shaft 20*a* and support shaft 20*b* towards and away from the surfaces of the paper web W in a substantially symmetrical manner and at substantially the same distances, in place of the worm wheel 33*a* and the worm wheel 33*b*, two mutually meshing gears are provided at the shaft ends 220*a* and 220*b*, with one gear being angularly displaced by a drive source so that the eccentric sleeves 22*a* and 22*b* are angularly displaced in mutually opposing directions.

In a still further embodiment C (not shown) of a drive transmission mechanism 3 for moving the support shaft 20*a* and support shaft 20*b* towards and away from the surfaces of the paper web W in a substantially symmetrical manner and at substantially the same distance, two driven pulleys are provided in place of the gears in embodiment B, and drive pulleys coupled to the rotational drive source are also provided. Belts then span across the driven pulleys and the drive pulleys and the eccentric sleeves 22*a* and 22*b* are angularly displaced in mutually opposite directions.

In another embodiment D (not shown) of a drive transmission mechanism 3 for moving the support shaft 20*a* and support shaft 20*b* towards and away from the surfaces of the paper web W in a substantially symmetrical manner and at substantially the same distance, arms are provided in a radial direction of the shafts at the shaft end 220*a* on the outer side of the frame F1 at the outer side of the eccentric sleeve 22*a* and at the shaft end 220*b* on the outer side of the frame F1 at the outside of the eccentric sleeve 22*b*. Cylinder rods of hydraulic cylinders taken as the respective drive sources are then coupled at the free ends of the arms and the free ends of the arms are then made to move by the extending and contracting of the respective cylinder rods so that the eccentric sleeves 22*a* and 22*b* are angularly displaced in mutually opposite directions.

The pressing member rotational drive means 4 is a device for rotating the rotating shaft 10*a* and contact points 11*a* of the pressing member 1*a* provided at the side of one surface of the traveling paper web W shown in FIG. 1, FIG. 2 and FIG. 4 and the rotating shaft 10*b* and contact points 11*b* of the pressing member 1*b* provided at the side of the other surface of the paper web W in mutually opposite directions.

The pressing member rotational drive means 4 comprises a drive mechanism 40 and a coupling arm mechanism 41.

The drive mechanism 40 is comprised of a driven gear 405*a* provided in both an integrated and rotating manner at the rotating shaft 10*a* at an end at the side of the frame F2 of the rotating shaft 10*a*, a driven gear 405*b* provided in both an integrated and rotating manner at the rotating shaft 10*b* at an end at the side of the frame F2 of the rotating shaft 10*b*, a central gear 403 meshing with the driven gear 405*a*, a drive gear 402 meshing with both gears between the central gear 403 and the driven gear 405*b*, and a drive source 400. The drive source 400 is fitted to a second coupling arm 411 of the coupling arm mechanism 41. In this embodiment, the drive source 400 is an electric motor. The directly meshing driven gear 405*b* and the driven gear 405*a* meshing via the central gear 403 are made to rotate in mutually opposite directions by rotation of a drive gear 402 provided at a rotational drive shaft 401. The rotating shaft 10*a* and contact points 11*a* of the pressing member 1*a* rotating integrally with the driven gear 405*a* and the rotating shaft 10*b* and the contact points 11*b* of the pressing member 1*b* rotating integrally with the driven gear 405*b* are made to rotate in the direction of travel of the paper web W and in a direction opposite to the direction of travel, respectively. As a result of this rotation, the speeds of the surfaces of the contact points 11*a* and the contact points 11*b* rotate at are made to be different to the speed of travel of the paper web W. The central gear 403 is provided in a rotatable manner at a central shaft 412 via a bearing 404 provided at the center of rotation.

The coupling arm mechanism 41 is comprised of a first coupling arm 410 provided in an angularly displaceable manner at the outer periphery of the support shaft 20*a* via a bearing 413, and a second coupling arm 411 provided in an angularly displaceable manner at the outer periphery of the support shaft 20*b* via a bearing 414 and the central shaft 412. The central shaft 412 is fitted in an angularly displaceable manner via a bearing 415 provided at a coupling hole of the first coupling arm 410 and is fitted in a fixed manner to a coupling hole 416 provided at the second coupling arm 411. The central gear 403 is provided in a rotatable manner at an end of the central shaft 412 via the bearing 404.

The coupling arm mechanism 41 is such that the first coupling arm 410 and the second coupling arm 411 are coupled by the central shaft 412 in such a manner that the sum of the distance between the center of rotation of the pressing member 1*a* and the axial center of the central shaft 412 and the center of rotation of the pressing member 1*b* and the axial center of the shaft 412 is usually larger than the distance between the center of rotation of the pressing member 1*a* and the center of rotation of the pressing member 1*b*. The movement of the pressing member 1*a* and the pressing member 1*b* can therefore be guaranteed regardless of movement of the pressing member 1*a* and the pressing member 1*b* due to the wavy surface adjustment means 2 and without the axial center of the central shaft 412 reaching dead center.

In a further embodiment of the drive mechanism 40, the pressing member 1*a* and the pressing member 1*b* are both made to rotate in the same direction rather than being made to rotate in opposite directions.

The drive mechanism 40 is provided so that gear transmission from the drive source 400 causes the pressing member 1*a* and the pressing member 1*b* to rotate. However, in a further embodiment (not shown), contact points 11*a* and 11*b* are made to rotate taking a belt transmission comprising a single drive source, a drive pulley linked to the drive source, two driven pulleys provided at the rotating shafts of the pressing members, a belt spanning the drive pulley and each of the driven pulleys, and a belt tension pulley that normally applies tension to the belt as a drive mechanism. It is therefore also possible to cause the speed that the peripheral surfaces of the contact points 11*a* and 11*b* are rotated at to be different from the speed of travel of the paper web W.

Next, a description is given of the operation of a first embodiment of this invention.

When the rotary press operates, the paper web W travels in a vertical direction from bottom to top while being printed on by each of the printing units P. The paper web width adjustment devices 100 provided sequentially in the path of travel of the paper web W between one printing unit P and a following printing unit P causes the contact points 11*a* and 11*b* of the pressing members 1*a* and 1*b* to move towards and away from the surfaces of the paper web W using the wavy surface adjustment means 2, presses the contact points 11*a* and 11*b* against the surfaces of the paper web W, and generates a ripple in the traveling paper web. The width of the paper web W is therefore adjusted by generating ripples in the paper web W.

The pressing members 1*a* and 1*b* are then rotatably driven by the pressing member rotational drive means 4 taking an axial center of rotation parallel to the paper web W as center. The pressing member rotational drive means 4 rotatably drives the drive gear 402 using the drive source 400 and the driven gear 405*b* engaging with the drive gear 402 and central gear 403 rotate in opposite directions. The central gear 403 meshes with the driven gear 405*a* and the driven gear 405*a* therefore rotates in the same direction as the drive gear 402.

The driven gear 405*a* is integrally fitted to the rotating shaft 10*a* and the contact points 11*a* of the pressing member 1*a* and the rotating shaft 10*a* and the plurality of contact points 11*a* therefore rotate in an integrated manner. The driven gear 405*b* integrally rotates with a member integrally fitted to the rotating shaft 10*b* and the plurality of contact points 11*b* of the pressing member 1*b*. The plurality of contact points 11*a* and the plurality of contact points 11*b* are collectively rotated in respectively opposite direction and rotational speed is set in such a manner that the speeds of the respective peripheral surfaces are different to the speed of travel of the paper web W.

During the operation of this kind of paper web width adjustment device 100, it is necessary to correct shifts in the printed image by adjusting the width of the paper web W in cases where the printed image shifts. In this case, it is necessary to activate the wavy surface adjustment means 2 so as to change to a ripple generating state with respect to the paper web W. The wavy surface adjustment means 2 then activates the rotational drive source 30, the rotational drive shaft 31 is caused to rotate in one direction, the worm 32*a* and worm 32*b* are made to rotate, and the worm 32*a* and worm 32*b* and the worm wheel 33*a* and worm wheel 33*b* with which the worms 32*a* and 32*b* engage are angularly displaced in mutually opposing directions.

The eccentric sleeve 22*a* coupled to the worm wheel 33*a*, the support shaft 20*a*, and the eccentric sleeve 23*a* are then collectively angularly displaced centered about a common center line of angular displacement as a result of the angular displacement of the worm wheel 33*a*. The eccentric sleeve 22*b* coupled to the worm wheel 33*b*, the support shaft 20*b*, and the eccentric sleeve 23*b* are then collectively angularly displaced centered about a common center line of angular displacement as a result of the angular displacement of the worm wheel 33*b*.

At the support shaft 20*a* and the support shaft 20*b* fixed to a position offset from a common center line of angular displacement of the eccentric sleeves 22*a*, 23*a* and the eccentric sleeves 22*b*, 23*b*, the rotatably provided rotating shaft 10*a* and contact points 11*a* of the pressing member 1*a* and the rotatably provided rotating shaft 10*b* and contact points 11*b* of the pressing member 1*b* are collectively angularly displaced and moved by substantially the same amount about a common center line of angular displacement for the eccentric sleeves 22*a* and 23*a* and the eccentric sleeves 22*b* and 23*b*.

The pressing member 1*a* and pressing member 1*b* positioned substantially opposite each other in a symmetrical manner with respect to the paper web W is made to move by the wavy surface adjustment means 2 to move towards and away from the surfaces of the paper web in a substantially symmetrical and equidistant manner. While being moved towards and away from the surface of the paper web W, the pressing members 1*a* and 1*b* are rotated in the same direction as and in the opposite direction to the direction of travel of the paper web W by the pressing member rotational drive means 4. The pressure with which the contact points 11*a* and the contact points 11*b* make contact so as to press against the surfaces of the paper web W is then corrected, the width of the paper web W is adjusted, and shifts in the printed image are corrected.

A ripple is therefore generated in the direction of the width of the paper web W due to this operation and the width of the paper web W can be adjusted by changing the rippling conditions. The paper web is then sent to the next printing unit P and overlaid printing takes place.

In this embodiment, the pressing members 1*a* and 1*b* arranging facing each other on either side of the paper web W move in a substantially symmetrical and equidistant manner towards and away from the paper web W so as to press from both sides of the paper web W so as to generate ripples in the paper web W. However, in a further embodiment, a pressing member 1*a* only provided at one side of the paper web W is moved towards and away from one surface of the paper web W, one side of the paper web W is pressed, and a ripple can be generated in the paper web W.

(1) The rotational speeds of the peripheral surfaces of the contact points of the pressing members making contact with the surfaces of the traveling paper may be made to be a different speed to the traveling speed of the paper web. Ink or specks of paper can therefore be prevented from becoming attached to contact points and accumulating and contamination of the printing paper surface can therefore be prevented.

(2) The process of attachment to the shafts of the pressing members or detaching from the shafts of the pressing members is made easier compared to the related art as a result of incorporating the plurality of contact points of the pressing members into an integral structure.

(3) It is possible to carry out ripple adjustment to make the pressing members move towards and away from the surfaces of the paper web from a side of just one end of a shaft supporting a pressing member. The device can therefore be simplified, costs can be reduced, and operation and maintenance checks can be made straightforward.

What is claimed is:

1. A paper web width adjustment device comprising:

one or more pressing members provided in a rotatable manner for making contact with surfaces of a traveling paper web and creating ripples in the paper web and having a plurality of contact points provided integrally so as to be spaced mutually at intervals along the widthwise direction of the paper web;

support shafts for supporting the pressing members in a rotatable manner;

ripple adjustment means capable of moving the support shafts towards and away from the surfaces of the paper web; and pressing member rotational drive means for, in cooperation with the pressing members, rotatably driving the pressing members collectively, wherein at least one of the pressing members is capable of moving towards and away from a surface of the paper web, and the rotational speed of the peripheral surfaces of the contact points of the pressing members can be rotatably driven at different speeds to the speed of travel of the paper web, wherein the ripple adjustment means comprises eccentric sleeves fitted in a fixed manner to the ends of the support shafts, and a drive transmission mechanism capable of angularly displacing the eccentric sleeves, being provided in such a manner that central lines of rotation of the pressing members provided to the support shafts in a rotatable manner and central lines of angular displacement of the eccentric sleeves are spaced from each other and are parallel to each other, with the eccentric sleeves being angularly displaced about the center line of angular displacement by the drive transmission means, and with the ripple adjustment means being capable of deciding the positioning of the pressing members with respect to the paper web.

2. The paper web width adjustment device of claim 1, wherein the drive transmission mechanism is equipped with worm wheels provided integrally with the eccentric sleeves in a rotatable manner, worms meshing with the worm wheels, and a rotational drive source for rotationally driving the worms.

3. A paper web width adjustment device comprising:

one or more pressing members provided in a rotatable manner for making contact with surfaces of a traveling paper web and creating ripples in the paper web and having a plurality of contact points provided integrally so as to be spaced mutually at intervals along the widthwise direction of the paper web;

support shafts for supporting the pressing members in a rotatable manner;

ripple adjustment means capable of moving the support shafts towards and away from the surfaces of the paper web; and pressing member rotational drive means for, in cooperation with the pressing members, rotatably driving the pressing members collectively, wherein at least one of the pressing members is capable of moving towards and away from a surface of the paper web, and the rotational speed of the peripheral surfaces of the contact points of the pressing members can be rotatably driven at different speeds to the speed of travel of the paper web, wherein two pressing members are provided facing each other on either side of the paper web, wherein the ripple adjustment means comprises eccentric sleeves fitted in a fixed manner to the ends of the support shafts, and a drive transmission mechanism capable of angularly displacing the eccentric sleeves, being provided in such a manner that central lines of rotation of the pressing members provided to the support shafts in a rotatable manner and central lines of angular displacement of the eccentric sleeves are spaced from each other and are parallel to each other, with the eccentric sleeves being angularly displaced about the center line of angular displacement by the drive transmission means, and with the ripple adjustment means being capable of deciding the positioning of the pressing members with respect to the paper web.

4. The paper web width adjustment device of claim 3, wherein the drive transmission mechanism is equipped with worm wheels provided integrally with the eccentric sleeves in a rotatable manner, worms meshing with the worm wheels, and a rotational drive source for rotationally driving the worms.

* * * * *